US006688597B2

(12) United States Patent
Jones

(10) Patent No.: US 6,688,597 B2
(45) Date of Patent: Feb. 10, 2004

(54) CASINO STYLE GAME OF CHANCE APPARATUS

(76) Inventor: Mark Hamilton Jones, 52 "G" St., Chula Vista, CA (US) 91910

( * ) Notice: Subject to any disclaimer, the term of this patent is extended or adjusted under 35 U.S.C. 154(b) by 138 days.

(21) Appl. No.: 09/810,812

(22) Filed: Mar. 15, 2001

(65) Prior Publication Data

US 2001/0035604 A1 Nov. 1, 2001

Related U.S. Application Data

(60) Provisional application No. 60/189,573, filed on Mar. 15, 2000.

(51) Int. Cl.[7] ..... A63F 9/00; A63F 13/00

(52) U.S. Cl. ..... 273/274; 273/309; 273/138.1; 273/138.2; 463/22; 463/16

(58) Field of Search ..... 273/292, 274, 273/309, 138.1, 138.2; 463/12, 13, 22, 16

(56) References Cited

U.S. PATENT DOCUMENTS 5,490,670 A 2/1996 Hobert
5,745,166 A * 4/1998 Rhodes ..... 348/143
5,762,552 A 6/1998 Vuong et al.
5,785,596 A 7/1998 Hobert
5,803,809 A * 9/1998 Yoseloff ..... 463/13
5,829,749 A 11/1998 Hobert
5,954,336 A 9/1999 Goossens et al.
6,065,752 A * 5/2000 Beltran ..... 273/274
6,123,335 A 9/2000 Adkins
6,179,710 B1 1/2001 Sawyer et al.

OTHER PUBLICATIONS

"Card Craps", Scarne's Encyclopedia of Games, John Scarne, Harper & Row Publishers, pp. 319–320, 1973.*

* cited by examiner

*Primary Examiner*—Benjamin H. Layno
(74) *Attorney, Agent, or Firm*—Thomas J. Tighe

(57) ABSTRACT

A casino game apparatus having a table layout similar to, or the same as, a craps game table using conventional craps rules, but without the dice. The preferred embodiment uses a pair of ball blowers, each selecting a numbered ball from six balls, numbered from one to six. A pair of monitors display the selected balls as viewed from video cameras mounted above the ball blowers, one number per monitor. The sum of the pair of numbers displayed constitute the random number decision generation replacing the use of dice. An additional embodiment uses a random number generator to select two numbers for random number decision generation. Another embodiment uses two shuffled card decks from which to select two numbered cards for random number decision generation. An additional embodiment uses a remote control activated by a player to initiate the random number generator for selection of two numbers for random number decision generation.

12 Claims, 4 Drawing Sheets

CASINO STYLE GAME OF CHANCE APPARATUS

This application claims the benefit of U.S. Provisional Application No. 60/189,573, filed Mar. 15, 2000.

BACKGROUND OF THE INVENTION

This invention relates in general to games of chance and more particularly to a casino game apparatus having a craps table layout played with conventional rules for craps, except the game is played without dice.

Casino games such as craps, roulette, poker and blackjack have become very popular over the years. They are popular with players and profitable for casinos. However, there are only a few places where people interested in such games can go to play because the games are not allowed in most states. Also, people are aware that dice, known as "loaded dice" can be made to favor particular results when rolled. Whether or not loaded dice are ever used in craps at casinos, players always have a lingering doubt that they might be, particularly since the odds always favor the casino. Therefore, a casino type craps game that can be played with a craps table layout, with craps rules, and with all the fanfare, excitement and ambience that players expect and enjoy at a casino, but with a completely random method of determining the results of a play or "roll" other than with dice, and for this reason may be played in more venues, is desired.

The apparatus of this invention uses a conventional craps table with a conventional craps table layout. However, since dice are not used in the game, a few minor variations would be made. There would be no depiction of dice on the layout. Also, the inside vertical wall of the table, normally used for bouncing the dice against during a roll, could have any surface rather than the usual diamond rubber cushioned surface of tables where dice are used.

The conventional game of craps uses a pair of dice, rolled simultaneously to generate a generally random number which is the sum of the resulting numbers of dots on the two upper faces of the dice when they come to rest. The play of the game is based on this outcome of the roll of dice, also known as a decision. Wagers can be made and each decision or succeeding decision determines whether or not a player wins or loses, based on the rules.

To play the game of this invention without the use of dice, several means can be used to generate a decision. One way to generate a decision is by using a pair of ball blowers, commonly used in bingo, each blower having balls numbered from one to six. The sum of the combination of the two numbered balls selected by the blowers would constitute a decision and the play of the game would continue based on this decision and the rules of the game. Another way of generating a decision is to use two decks of cards, each deck having six cards, each card marked with a separate, distinct number from one to six, inclusive (representing the numbers of dots on the sides of a die). Each deck would be shuffled by a card shuffler and one card dealt from each of the shufflers. The sum of the combination of the two numbered cards dealt would constitute a decision. Another way of generating a decision is to use a random number generator (hereafter ("RNG"), to select two numbers from one to six, inclusive. The combination of the two numbers would constitute a decision. Two RNGs could also be used, each selecting a number from one to six, inclusive, the combination constituting a decision. Also, a player can be allowed to use a remote control to activate the RNG or RNGs to select two numbers, the combinations of which would constitute a decision. Large monitors can be positioned for players and observers to easily view the results of the selected numbers which would be displayed on the monitors.

Other advantages and attributes of this invention will be readily discernable upon a reading of the text hereinafter.

SUMMARY OF THE INVENTION

An object of this invention is to provide a casino game having a craps table layout.

An additional object of this invention is to provide a casino game having a craps table layout which can be played by conventional craps rules, but without dice.

An additional object of this invention is to provide a casino game having a craps table layout without any depiction of dice on the table.

An additional object of this invention is to provide a casino game having a craps table layout where the table's inside vertical walls can be any surface.

An additional object of this invention is to provide a casino game having a craps table layout in which a random number decision generation replacing the use of dice can be obtained by a pair of balls selected by a pair of ball blowers where each ball blower has a set of balls numbered from one to six, inclusive.

An additional object of this invention is to provide a casino game having a craps table layout in which a random number decision generation, replacing the use of dice, can be obtained by a pair of numbers selected by a random number generator which selects two numbers at random, each selected number being in the range from one to six, inclusive.

An additional object of this invention is to provide a casino game having a craps table layout in which a random number decision generation replacing the use of dice can be obtained by dealing a pair of cards from two decks of cards each shuffled by a card shuffler where the card decks are each a set of cards numbered from one to six, inclusive.

An additional object of this invention is to provide a casino game having a craps table layout in which a random number decision generation replacing the use of dice can be obtained by a pair of numbers selected by a random number generator which selects two numbers at random in the range from one to six, inclusive, when activated by a remote control.

A further object of this invention is to provide a casino game having a craps table layout in which the results of the random number decision generation replacing the use of dice can be displayed for the players and observers to see.

These objects, and other objects expressed or implied in this document, are accomplished by a game of chance including a table top having a set of indicia for placing bets thereupon, a number selector which when actuated for a game, produces two randomly selected numbers, the selected numbers being determinative of the game's winning indicia, and a display associated with the table, for displaying the selected numbers, the display being clearly viewable by all the players at the table. In one embodiment the number selector includes two separate ball selectors each of which, when actuated, randomly singulates one of a respective plurality of numbered, agitated balls contained within a respective chamber, the number on the singulated ball being a selected number. Each chamber contains six balls, each ball marked with a different number, the numbers ranging from one to six, inclusive. Each ball selector further includes a blower within its chamber, a ball singulating chute communicating with the chamber, and a gate to the chute which is opened when said each ball selector is actuated, wherein a ball is selected by being blown to the top of its respective chamber and into the singulating chute. Preferably the display includes a structure proximate the table and disposed, in part, above the number selectors, two cameras affixed to the structure proximate respective singulated balls for viewing the number on the ball, and at least one display screen affixed to the structure for displaying to participants and observers of the game the cameras' view of the singulated balls. Preferably the table's indicia resembles the indicia of a conventional craps table.

In another embodiment the number selector includes a numerical processor proximate the table, software installed in the processor for selecting two numbers at random, when actuated, and a display communicating with the processor for displaying the selected numbers, the display being clearly viewable by all the players at the table. Preferably the two random numbers is selected from a range of one to six, inclusive. Also preferably a remote control communicates with the processor for remotely activating the software for selecting the random numbers.

In another embodiment the number selector includes two separate decks of numbered cards, at least one shuffler for arranging each deck in a random sequence, and respective structures for assisting a dealer in singulating one numbered card from each of the shuffled decks. The display is preferably the singulated cards disposed to allow all players at the table to view the number on each card and preferably all the cards of both decks are numbered from 1 to six, inclusive.

DESCRIPTION OF THE PREFERRED EMBODIMENT

Figure 1:
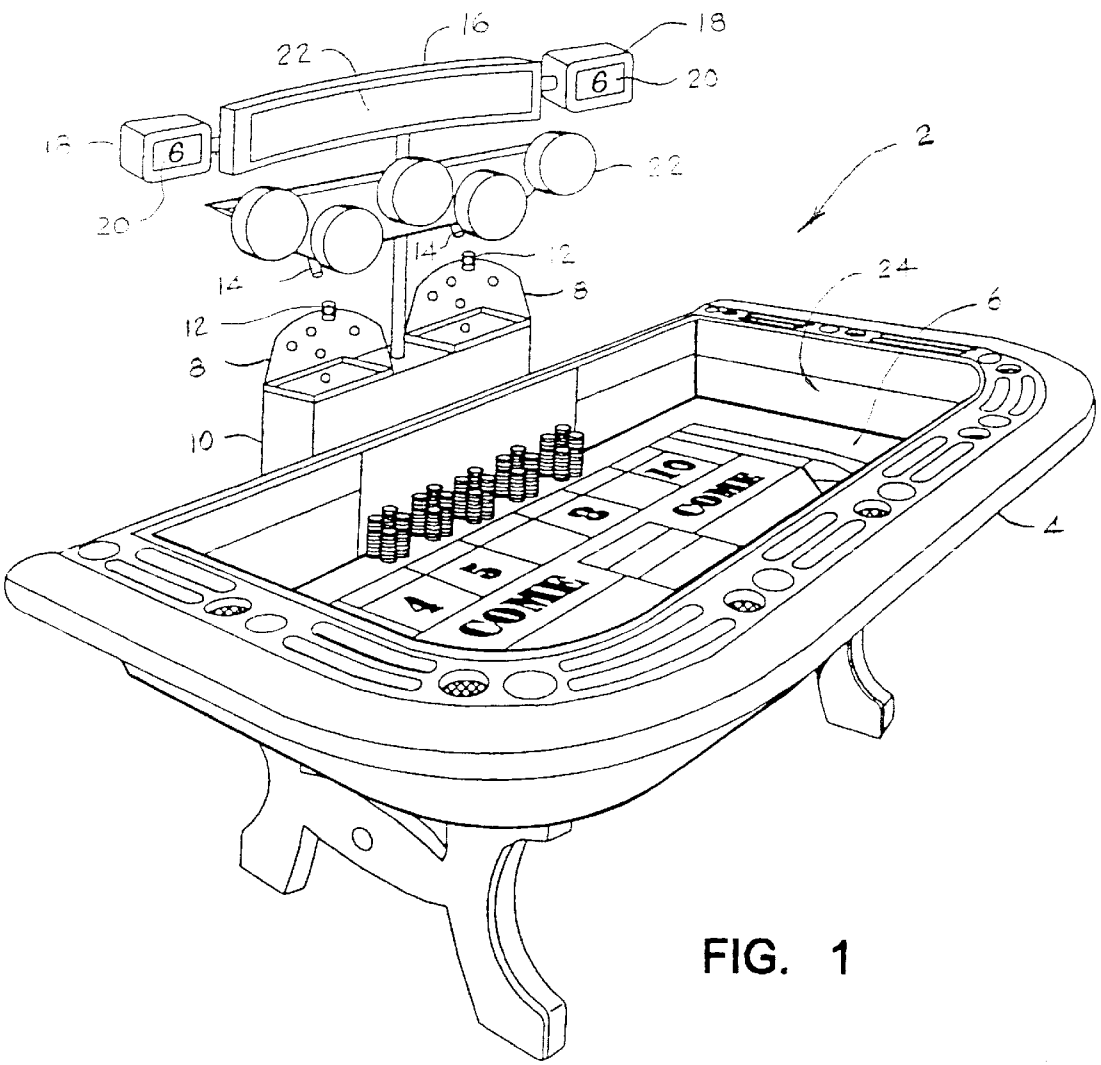
FIG. 1 is a pictorial view of the preferred embodiment of the invention.

Referring to FIG. 1, the preferred embodiment of the invention is shown and generally designated 2. A generally conventional craps table 4 used in playing the casino game of the invention has a generally conventional craps table layout 6. Two ball blowers 8 used with the table and part of the craps game, as will be explained later, are mounted on a base 10 which is set apart from the craps table a short distance to allow the dealer to move between the table and the base. The ball blowers are preferably of a type commonly used in bingo games where one of a set of lightweight, numbered, plastic balls can be randomly selected. The balls are kept in movement inside a transparent cover and, when the blower is activated, one ball nearest the entrance of a tubular ball chute (not shown) is selected by allowing the ball to enter the chute where it is blown to the top of the chute 12. In the top of the chute the ball can be viewed by the dealer and players and can also be viewed by a video camera 14. A display structure 16 is mounted above the ball blowers, preferably affixed to the base 10. Two video cameras 14 are affixed to the display structure, one above each ball blower 8, so the number on each of the balls selected by the ball blowers can be viewed in the top of the chutes 12 by the cameras. Two display monitors 18 are affixed to the display structure, positioned for easy viewing of the dealer, players and observers. Each monitor displays the camera's view 20 of the selected ball in the top of the chute of the closest ball blower. The view 20 is the number marked on the ball that is in the top of the chute. One monitor will show the number of one selected ball and the other monitor will show the number of the other selected ball. The sum of the pair of numbers displayed constitute the random number decision generation replacing the use of dice and play resulting from the decision will proceed according to the conventional craps rules. Thus, instead of the numbers representing the dots on the upward faces of a pair of rolled dice, it would be the numbers on the selected pair of balls that would determine the play according to conventional craps rules. The display structure 16 can contain signage 22 with flashing lights for adding additional casino atmosphere to the game.

The play is by craps rules, with players making bets on the table layout 6. Since dice are not used in the game, the layout does not contain any indicia of dice. For example, to show the odds for various combinations of numbers resulting from a random number decision generation, the numbers would be shown in circles to represent the balls, rather than by showing dots in squares to represent the face of dice. Also, since dice are not used in the game, there is no need for having the inside vertical wall 24 covered by a diamond rubber surface commonly used in conventional craps tables. The ball blowers 8 each contain six balls, each ball in a blower is marked with a separate, distinct number from one to six, inclusive. When the players have placed their bets, the dealer will start the ball blowers causing the balls in the ball blowers to be continually stirred. After the balls have been allowed to be stirred, the dealer will push a "select" button on his blower control unit (not shown) which will open access for the balls to the bottom of the chute. A blower forcing air up the chute will cause the next ball that passes the opening to the bottom of the chute to be forced up the chute where it can be observed in the top of the chute 12 by a video camera 14. The ball's number 20, as viewed by the camera will be displayed on the screen of a display monitor 18. Both ball blowers will each select a numbered ball and the results of the selections will be displayed on the monitor for the dealer, players and observers. The sum of these numbers constitutes a random number decision generation and would be treated the same under the rules as if a pair of dice were rolled and the results were the same as the numbers selected. The use of the ball blowers to select the random number decision generation creates a lottery style game, with no material difference from those used in many states having lotteries, including California.

Figure 2:
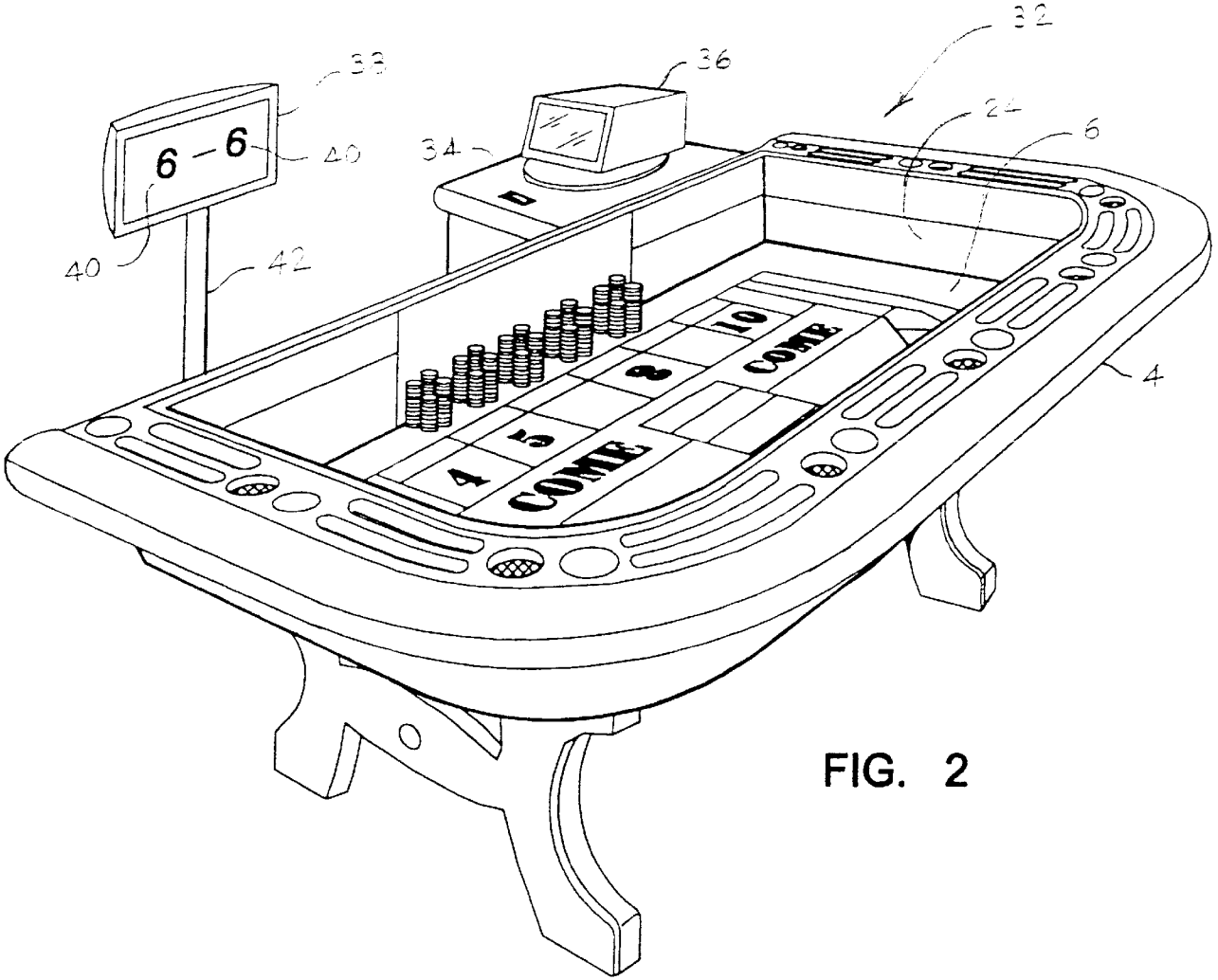
FIG. 2 is a pictorial view of another embodiment of the invention.

Referring to FIG. 2, another embodiment of the invention is generally designated 32. This embodiment uses the craps table 4 having a craps table layout 6 of the preferred embodiment. And, since no dice are used in the game, the table's inside vertical walls 24 do not need to have a particular surface. In this embodiment there is a dealer's control unit 34 preferably positioned adjacent to the table. A monitor or CRT 36 is supported by the control unit. The control unit contains a small computer having software for random number generation of a number from one to six, inclusive. The generation of the number will be based on the odds of picking one card from a six card deck. At the dealer's signal, the random number generator software selects a first random number which it holds. It then selects a second random number, also based on the odds of picking one card from a six card deck. When the second number is selected, both numbers are displayed on the screen of the CRT for the dealer and players to see. The selection of the two random numbers can also be accomplished by the use of two separate random number generators in the control unit. Also, a display monitor 38 displays the selected numbers 40 for the dealer, players and observers to see. The numbers are displayed in split screen fashion, with one number displayed on one side of the screen and the other number displayed on the other side of the screen, allowing both selected numbers to be visible on the screen at the same time. The monitor can be supported by a rigid hollow tube 42 affixed to the table. The monitor could also be mounted on a stand or other base placed some distance from the table. The monitor 38 could also be replaced by two separate monitors (not shown), one for showing one selected number and the other for showing the other selected number. The electronic components contained in the control unit 34 could also be housed in a secure enclosure (not shown) affixed beneath the table. The control unit or enclosure affixed beneath the table would be locked and sealed by the gaming commission responsible for the play of such games prior to the start of play.

When the players have made their bets the dealer signals the control unit 34 to select two numbers. The software in the control unit would have the random number generator select two numbers. The selection is so fast that there is no discernable delay. Or, two separate random number generators could be used, each selecting one number. The selected numbers 38 are displayed on the CRT 36 and the split screen of a display monitor 38. The sum of these numbers constitutes a random number decision generation and would be treated the same under the rules as if a pair of dice were rolled and the results were the same as the numbers selected.

Figure 3:
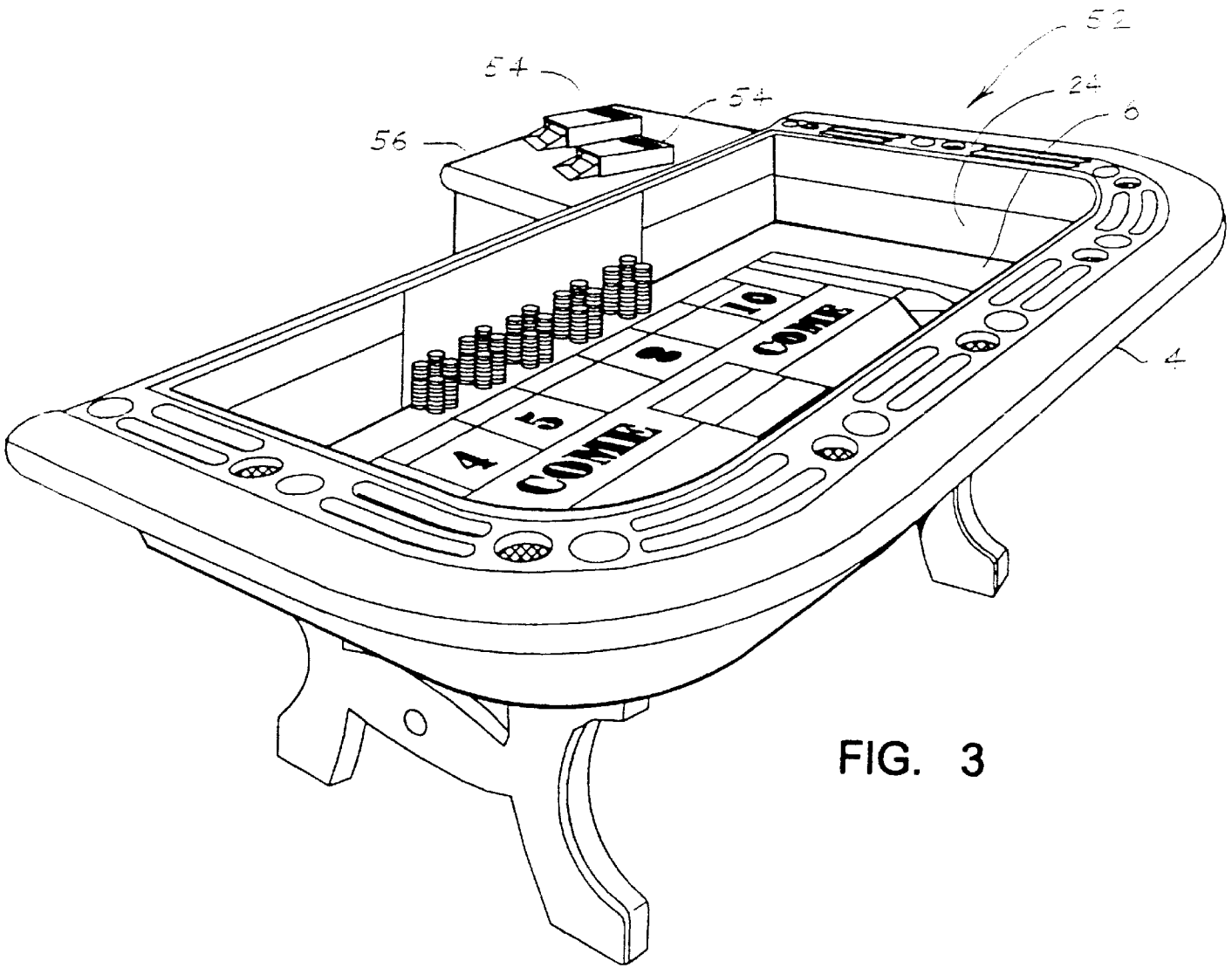
FIG. 3 is a pictorial view of another embodiment of the invention.

Referring to FIG. 3, another embodiment of the invention is generally designated 52. This embodiment uses the craps table 4 having a craps table layout 6 of the preferred embodiment. And, since no dice are used in the game, the table's inside vertical walls 24 do not need to have a particular surface. In this embodiment two card shufflers 54 are used to provide the random number decision generation. The shufflers are supported by a base 56, preferably positioned adjacent to the table. A shelf (not shown) affixed to the edge of the table can also be used to support the card shufflers. Two six card decks of cards are used. Each deck has cards marked with the numbers from one to six, inclusive. When the players have made their bets the dealer inserts the card decks into the shufflers, one deck into each shuffler. The shufflers thoroughly shuffle the cards and the dealer then draws one card from each shuffler. The cards are held or placed so the players and observers can see the cards. The sum of the pair of numbers displayed on the selected cards constitute the random number decision generation, replacing the use of dice, and play resulting from the decision will proceed according to the conventional craps rules. While not shown, the invention encompasses the mounting of a video camera for viewing the two cards drawn by the dealer for displaying on the screen of a display monitor placed in position for the players and observers to see the results of the draw. By using cards the game becomes a house banked percentage card game.

Figure 4:
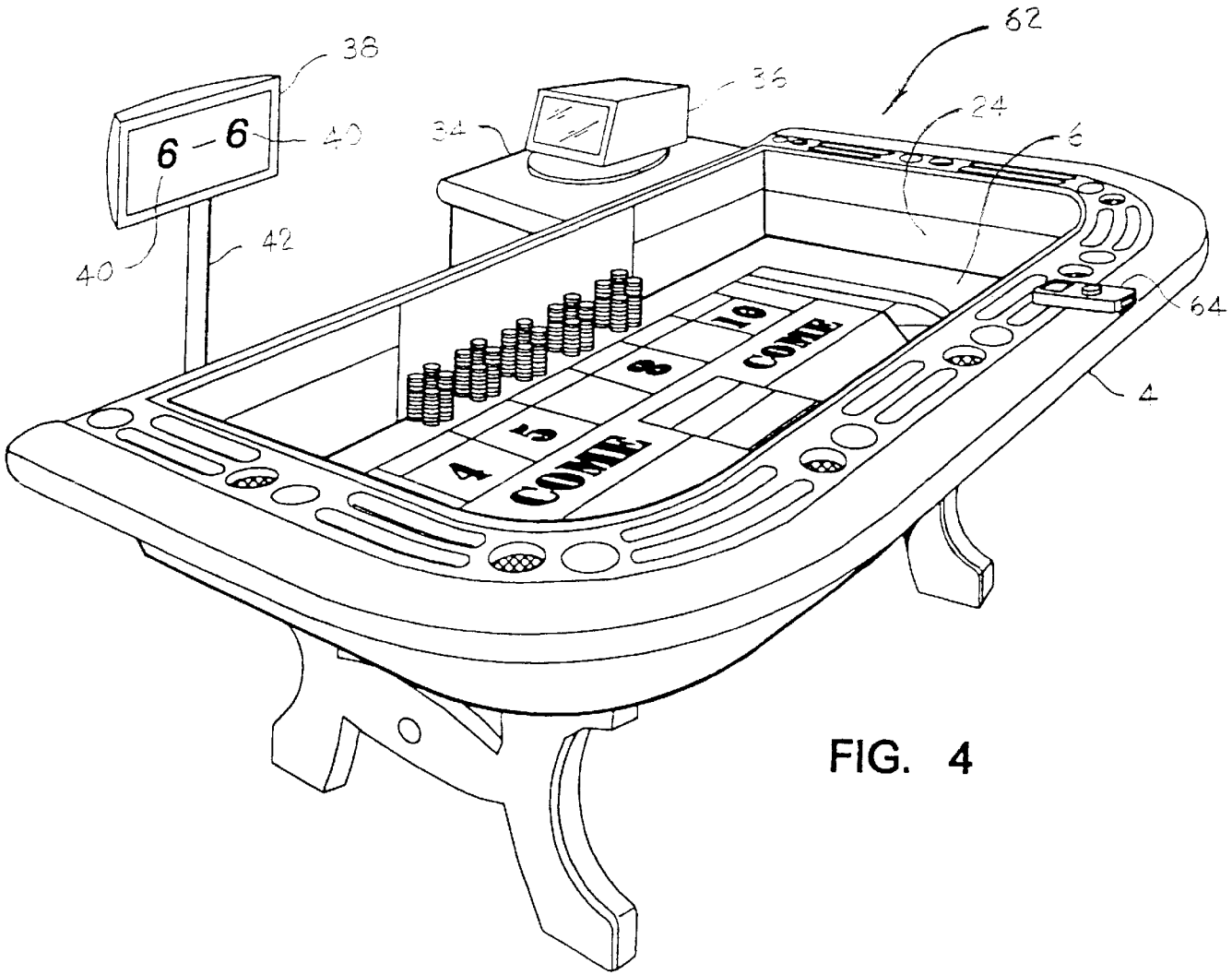
FIG. 4 is a pictorial view of another embodiment of the invention.

Referring to FIG. 4, another embodiment of the invention is generally designated 62. This embodiment uses the craps table 4 having a craps table layout 6 of the preferred embodiment. And, since no dice are used in the game, the table's inside vertical walls 24 do not need to have a particular surface. In this embodiment there is a dealer's control unit 34 preferably positioned adjacent to the table. A monitor or CRT 36 is supported by the control unit. The control unit contains a small computer having software for random number generation of a number from one to six, inclusive. The generation of the number will be based on the odds of picking one card from a six card deck. To provide an increased sense of involvement for the players, a remote control 64 can be operated by a player. The remote control can communicate electrically with the control unit by means of a control cable (not shown), or wirelessly by means of electronic transmission, in similar fashion as a garage door opener's remote control communicates with the opener. The remote control would activate the random number generation software in the control unit to select two random numbers. The software would select a first random number which it holds and then it would select a second random number, also based on the odds of picking one card from a six card deck. When the second number is selected, both numbers are displayed on the screen of the CRT for the dealer and players to see. The selection of the two random numbers can also be accomplished by the use of two separate random number generators in the control unit. Also, a display monitor 38 displays the selected numbers 40 on the screen of the monitor for the dealer, players and observers to see. The numbers are displayed in split screen fashion, with one number displayed on one side of the screen and the other number displayed on the other side of the screen, allowing both selected numbers to be visible on the screen at the same time. The monitor can be supported by a rigid hollow tube 42 affixed to the table. The monitor could also be mounted on a stand or other base placed some distance from the table. The monitor 38 could also be replaced by two separate monitors (not shown), one for showing one selected number and the other for showing the other selected number. The electronic components contained in the control unit 34 could also be housed in a secure enclosure (not shown) affixed beneath the table. The control unit or enclosure affixed beneath the table would be locked and sealed by the gaming commission responsible for the play of such games prior to the start of play.

When the players have made their bets the dealer would hand the remote control 64 to a player to initiate the play of the game. The player would press the button (not shown) on the remote control which would signal the control unit 34 to select two numbers. The software in the control unit would have the random number generator select two numbers. The selection is so fast that there is no discernable delay. The selected numbers 40 are displayed on the CRT 36 and the split screen of a display monitor 38. The sum of the pair of selected numbers displayed constitute the random number decision generation replacing the use of dice and play resulting from the decision will proceed according to the conventional craps rules.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. A game of chance simulating Craps comprising:

(a) a table including indicia for placing bets thereupon, said indicia resembling the indicia of a conventional craps table, and (b) two separate, decks of cards, each deck randomly ordered, each deck consisting of six cards, bearing indicia respectively corresponding to the six sides of a conventional die, two cards drawn one from each deck being representative of a pair of tossed dice.

2. The game according to claim 1 further comprising a display associated with the table, for displaying the drawn cards, the display being viewable by players at the table.

3. The game according to claim 2 further comprising:

(a) at least one shuffler for arranging each deck in a random order, and (b) respective structures for assisting a dealer in singulating one card from each of the shuffled decks.

4. The game according to claim 3 wherein the display comprises a video camera disposed to focus on the drawn cards and a video display in communication with the camera.

5. The game according to claim 4 wherein each deck comprises six cards each bearing indicia uniquely corresponding to the dots on a side of a die.

6. The game according no claim 3 wherein each deck comprises six cards each bearing indicia uniquely corresponding to the dots on a side of a die.

7. The game according no claim 2 wherein the display comprises a video camera disposed to focus on the drawn cards and a video display in communication with the camera.

8. The game according to claim 7 wherein each deck comprises six cards each bearing indicia uniquely corresponding to the dots on a side of a die.

9. The game according to claim 2 wherein each deck comprises six cards each bearing indicia uniquely corresponding to the dots on a side of a die.

10. The game according to claim 1 further comprising:

(a) at least one shuffler for arranging each deck in a random order, and (b) respective structures for assisting a dealer in singulating one card from each of the shuffled decks.

11. The game according no claim 10 wherein each deck comprises six cards each bearing indicia uniquely corresponding to the dots on a side of a die.

12. The game according to claim 1 wherein each deck comprises six cards each bearing indicia uniquely corresponding to the dots on a side of a die.

* * * * *

UNITED STATES PATENT AND TRADEMARK OFFICE

CERTIFICATE OF CORRECTION

PATENT NO. : 6,688,597 B2
DATED : March 23, 2004
INVENTOR(S) : Mark Hamilton Jones It is certified that error appears in the above-identified patent and that said Letters Patent is hereby corrected as shown below:

Column 7,
Lines 17 and 19, reads “no” should be -- to --

Column 8,
Line 15, reads “no” should be -- to --

Signed and Sealed this

Fifteenth Day of June, 2004

JON W. DUDAS
*Acting Director of the United States Patent and Trademark Office*